US009328917B2

(12) United States Patent
Yousif et al.

(10) Patent No.: US 9,328,917 B2
(45) Date of Patent: May 3, 2016

(54) FLOW CONTROL DEVICE

(75) Inventors: Safwan Yousif, Renfrew (GB); Babak Aghdaee, Renfrew (GB); Gerard John Hesselmann, Crawlay (GB)

(73) Assignee: DOOSAN BABCOCK LIMITED, Sussex (GB)

( * ) Notice: Subject to any disclaimer, the term of this patent is extended or adjusted under 35 U.S.C. 154(b) by 1023 days.

(21) Appl. No.: 13/508,593

(22) PCT Filed: Nov. 10, 2010

(86) PCT No.: PCT/GB2010/051871

§ 371 (c)(1),
(2), (4) Date: Aug. 6, 2012

(87) PCT Pub. No.: WO2011/058352

PCT Pub. Date: May 19, 2011

(65) Prior Publication Data

US 2013/0029274 A1 Jan. 31, 2013

(30) Foreign Application Priority Data

Nov. 16, 2009 (GB) ..... 0919964.7

(51) Int. Cl.

| | |
|---|---|
| ***F23Q 2/32*** | (2006.01) |
| ***F23D 1/00*** | (2006.01) |
| ***F23C 7/00*** | (2006.01) |
| ***F23L 13/06*** | (2006.01) |
| *F16K 11/00* | (2006.01) |

(52) U.S. Cl.

CPC . *F23D 1/00* (2013.01); *F23C 7/008* (2013.01); *F23L 13/06* (2013.01); *F23D 2900/00003* (2013.01); *Y10T 137/877* (2015.04)

(58) Field of Classification Search

USPC ..... 431/235

See application file for complete search history.

(56) References Cited

U.S. PATENT DOCUMENTS

| | | | | | |
|---|---|---|---|---|---|
| 1,436,823 | A | * | 11/1922 | Purnell | 431/183 |
| 1,576,537 | A | * | 3/1926 | Peabody | 431/183 |
| 2,325,443 | A | * | 7/1943 | Vroom | 431/184 |
| 2,325,444 | A | * | 7/1943 | Vroom et al. | 431/186 |
| 2,754,845 | A | * | 7/1956 | Phillips | 137/886 |
| 2,757,721 | A | * | 8/1956 | Reed et al. | 431/183 |
| 2,839,080 | A | * | 6/1958 | Copeland | 137/625.4 |
| 2,911,034 | A | * | 11/1959 | Webb | 239/406 |
| 2,981,320 | A | * | 4/1961 | Reed | 431/188 |
| 3,818,937 | A | * | 6/1974 | LaGanke | 137/893 |
| 5,011,400 | A | * | 4/1991 | Vatsky | 431/4 |
| 5,062,352 | A | * | 11/1991 | Ostrand | 454/121 |
| 5,350,335 | A | * | 9/1994 | Andersson | 454/121 |
| 5,366,408 | A | * | 11/1994 | Andersson | 454/121 |
| 5,399,120 | A | * | 3/1995 | Burns et al. | 454/126 |
| 5,564,979 | A | * | 10/1996 | Sumiya et al. | 454/121 |
| 5,664,881 | A | * | 9/1997 | Hawkins et al. | 366/4 |

(Continued)

FOREIGN PATENT DOCUMENTS

GB 2 159 266 A 5/1984

*Primary Examiner* — Gregory Huson
*Assistant Examiner* — Martha Becton
(74) *Attorney, Agent, or Firm* — Sughrue Mion, PLLC

(57) ABSTRACT

A flow control device for partitioning a fluid flow from a common supply stream into at least two delivery streams by means of a common reciprocating damper such as a cylindrical sleeve damper. A combustion device using such a flow control device to partition a gas supply thereto and a combustion apparatus such as a boiler incorporating such combustion devices are also described.

21 Claims, 3 Drawing Sheets

(56) References Cited

U.S. PATENT DOCUMENTS

| | | | | | |
|---|---|---|---|---|---|
| 5,676,595 | A * | 10/1997 | Sumiya et al. | 454/121 |
| 5,720,657 | A * | 2/1998 | Kamiya et al. | 454/121 |
| 5,762,007 | A * | 6/1998 | Vatsky | 110/264 |
| 5,878,676 | A * | 3/1999 | Jochem et al. | 110/261 |
| 5,979,492 | A * | 11/1999 | Miller | 137/426 |
| 6,062,298 | A * | 5/2000 | Lee | 165/42 |
| 6,113,483 | A * | 9/2000 | Schambre et al. | 454/121 |
| 6,220,188 | B1 * | 4/2001 | Boutrup | 110/163 |
| 6,431,976 | B1 * | 8/2002 | Auquier | 454/121 |
| 7,241,216 | B2 * | 7/2007 | Kamsma | 454/126 |
| 7,371,161 | B2 * | 5/2008 | Goupil et al. | 454/156 |
| 7,527,551 | B2 * | 5/2009 | Goupil et al. | 454/121 |
| 7,766,078 | B2 * | 8/2010 | Kim et al. | 165/204 |
| 2002/0084058 | A1 * | 7/2002 | Ozeki et al. | 165/42 |
| 2003/0178011 | A1 * | 9/2003 | Pellizzari et al. | 123/549 |
| 2005/0211941 | A1 * | 9/2005 | LaVergne | 251/250 |
| 2005/0217236 | A1 * | 10/2005 | Wernberg et al. | 60/39.281 |
| 2007/0240650 | A1 * | 10/2007 | Schoell | 123/25 P |
| 2008/0000215 | A1 * | 1/2008 | Duncan | 60/204 |
| 2008/0099092 | A1 * | 5/2008 | Hasko et al. | 137/872 |
| 2009/0087805 | A1 | 4/2009 | Ochi et al. | |

* cited by examiner

FLOW CONTROL DEVICE

INTRODUCTION

The present invention relates to a flow control device for partitioning a fluid flow from a common supply stream into at least two delivery streams. The invention particularly finds application for the splitting of a gas flow stream in a combustion device and for example in the control of flow of combustion air or overfire air in a burner for firing fossil fuels. In the preferred case the invention relates to a pulverised coal fired burner, though it is also applicable to burners for other fossil fuels such as light oils, heavy fuel oil, orimulsion, and natural gas, etc.

BACKGROUND

Splitting of the combustion air flow is a well established technique for minimising the emissions of nitrogen oxides (NO, $NO_2$, and $N_2O$, collectively referred to as NOx) that arise from burning any fossil fuel. Burners designed to minimise NOx emissions are known as Low-NOx burners. The invention particularly relates to low nitrogen oxide burners which split combustion air into inner and outer streams, for example so as to stabilize flame and also reduce NOx emissions.

In pulverised coal combustion without NOx control measures, most of the NOx is produced by the oxidation of the organically bound nitrogen in the fuel (so-called fuel NOx), with a lesser amount deriving from atmospheric nitrogen which is oxidised at high temperature (so-called thermal NOx). Controlling the mixing of the combustion air with the fuel leads to the creation of conditions which favour reactions leading to $N_2$ in preference to NOx. These conditions are created in a low NOx burner by aerodynamic means. Typically the combustion air is split into two or more discrete streams, some of which may have a tangential velocity component imposed by means of spin vanes (known as swirl).

The combustion air split may be external to the burner at the windbox, but is more typically undertaken within the burner itself. In each case separate dampers are used to regulate the air flow to each stream within the burner. Such dampers can suffer from a number of difficulties; they may have a non-linear flow response to the damper position, the flow may not be responsive to movement in damper position making control difficult, and some arrangements of damper are difficult to adjust manually. Sleeve type dampers are often favoured, as they are relatively low cost components and avoid some of the manual adjustment difficulties.

Generally, and especially in the case of low NOx burners, the burner assembly comprises of a series of concentrically arranged pipes to supply the fuel and combustion air. To facilitate the flow split between the combustion air streams, and optionally to regulate the air flowrate, internal dampers are an integral feature of fossil fuel burners.

The design of the moveable mechanical components in a fossil fuel burner is an important aspect of the burner design; it can impact on the operation and performance of the burner, the pressure loss of the air flow through the burner, the cost of fabricating the burner, and the ease of maintaining the burner once it is installed.

Generally each air stream within a burner is independently regulated by an individual damper device, though in some burner designs there may be no regulation of one or more of the air streams. This gives rise to a number of issues, including in a typical case one or more of the following.

1) The desired air flow split can be achieved at a number of different damper positions, and this can include settings where the dampers restrict the flow more than is necessary to regulate flow split. As a result such systems are prone to increased pressure drop, leading to increased operational costs (electrical power consumption by the fans used to supply the combustion air).
2) The requirement for multiple dampers leads to increased mechanical complexity, and hence increased fabrication cost and maintenance cost.
3) Operation of one damper impacts the flow to all air streams supplied from the windbox, and hence requires adjustment of the other dampers, leading to greater difficulty in establishing the optimum burner operating settings and increased commissioning cost.

SUMMARY OF INVENTION

According to a first aspect of the present invention, there is provided a flow control device for partitioning a fluid flow from a common supply stream into at least two delivery streams comprising:

an elongate conduit comprising an outer wall and internal flow partitioning means defining internal flow zones for such delivery streams;

one or more inlet flow control apertures disposed in the outer conduit wall to provide a flow inlet into each such internal flow zone, the internal flow partitioning means being so configured that flow inlet(s) to the respective internal flow zones are spaced apart on the conduit wall;

a common movable flow control damper disposed about the outer conduit wall surface comprising at least one damper member movable about and over a portion of the conduit surface at which the inlet flow control aperture(s) defining a fluid supply to each of the said internal gas flow zones are located in such manner as to selectively restrict flow through the inlet flow control aperture(s) of the respective internal flow zones so as to effect relative flow modification between the said delivery streams.

In accordance with the first aspect of the invention an elongate conduit is thus internally partitioned to define at least two longitudinal fluid flow zones therewithin. Each of the flow zones comprises one or more inlet flow control apertures in the form of apertures in a conduit wall defining a gas supply route from a common supply fluidly communicating with a fluid flow zone externally of the elongate conduit wall. The flow inlet(s) thereby defined for the respective longitudinal flow zones are offset from each other along the conduit wall. This is effected by appropriate configuration of the internal flow partitioning means to create separate internal fluid flow zones in such manner that a first zone is enabled to fluidly communicate with a fluid flow zone externally of the elongate conduit wall at a first position on the wall and further zone(s) are enabled to fluidly communicate with a fluid flow zone externally of the elongate conduit wall at further position(s) on the wall offset from the first position.

At least one damper member is movable about and over a portion of the conduit surface on which the flow inlet(s) defining a fluid supply to each of the said internal gas flows are located. In a preferred case, the damper member is movable in the direction that the flow inlet(s) to the respective internal flow zones are spaced but this need not necessarily be the case, provided the shape and spacing of the apertures and the shape and movement of the damper are such as to produce the required flow modification between the delivery streams.

In the preferred case the damper member is configured to partition flow between two zones in that a first zone is enabled to fluidly communicate with a fluid flow zone externally of the elongate conduit wall by provision of flow control aperture(s) at a first location on the wall and a second zone is enabled to fluidly communicate with a fluid flow zone externally of the elongate conduit wall by provision of flow control aperture(s) at a second location offset from the first location, and the damper member sits between the two locations to be movable in the offset direction so as to selectively occlude the respective flow control aperture(s) to a varying extent.

In the preferred case the flow inlet(s) thereby defined for the respective longitudinal flow zones are longitudinally offset from each other along the conduit wall. The damper comprises at least one damper member adapted to reciprocate longitudinally. However, in certain applications the flow inlet(s) thereby defined for the respective longitudinal flow zones may be circumferentially offset from each other along the conduit wall or arranged in some other pattern, provided always that the at least one damper member is movable about and over that portion of the conduit surface at which the inlet flow control aperture(s) defining a fluid supply to each of the said internal gas flow zones are located in such manner as to selectively modify flow between the said delivery streams.

The flow control aperture(s) may comprise elongate slots in the elongate conduit wall and/or damper member which are preferably elongate in a movement direction of the damper member. Additionally or alternatively the flow control aperture(s) may comprise plural arrays of smaller holes and for example arrays elongate in a movement direction of the damper member that are progressively exposed and occluded by movement of the damper member. The patterns of holes may have the same or increasing or decreasing size and common or variable spacing.

The damper member is movable, in the preferred case longitudinally, over the inlet flow control aperture(s) in the conduit surface in such manner as to selectively restrict flow therethrough. In a simplest case a damper member may simply comprise a closure acting to occlude inlet flow control aperture(s) in the conduit surface when positioned over them, and to open inlet flow control aperture(s) in the conduit surface when positioned away from them. Any complexities of shape, pattern etc to optimise flow through the inlet flow control aperture(s) may be achieved by modifying their size, shape, distribution etc on the conduit surface. Discussion below considers this as the generally preferred case.

However, the principles of the invention are equally applicable where a damper member comprises a closure itself defining flow control apertures, the damper acting selectively to vary flow through inlet flow control aperture(s) in the conduit surface by any relative juxtaposition of the closure and the inlet flow control aperture(s) in the conduit surface. Complexities of shape, pattern etc to optimise flow may then be achieved by analogy by modifying their size, shape, distribution etc of either or both such apertures.

In all such cases, movement of the common flow control damper, in the preferred case longitudinally, selectively varies flow to the delivery streams through inlet flow control aperture(s) in the conduit surface by varying the open area thereof. In particular preferably, movement of the common flow control damper in a given direction simultaneously increases the open area to one delivery stream and decreases the open area to another delivery stream.

In a preferred case, the variation in area is non-linear with movement of the common flow control damper in that the reduction rate reduces as the damper moves to a position where the open area tends to a more restricted (i.e. more nearly completely occluded) condition. This may be achieved by varying the shape and/or distribution of apertures in the conduit wall and/or the damper member as the case may be. In particular, apertures may be fewer in number and/or taper in extent as the closed condition is approached. Surprisingly, this non-linear variation where the open area reduces more rapidly with movement of the damper in a more open state and less rapidly with movement of the damper in a less open state tends to produce a more linear flow response than would be the case without such modification.

In the preferred case apertures are appropriately tapered in a movement direction of the damper from a wider extent to a narrower extent in a direction corresponding to the direction of travel of the damper member as it tends to a position where it restricts flow.

For example in the preferred case where a damper is adapted to reciprocate longitudinally each inlet flow control aperture comprises an elongate longitudinal slot which is tapered in a transverse direction from a wider extent to a narrower extent in a direction corresponding to the direction of travel of the damper member as it tends to a position where it restricts flow to a delivery stream to which the aperture communicates.

Preferably a tapered aperture is provided in the conduit wall. Optionally a tapered aperture is provided in the damper member and cooperably located with an aperture in the conduit wall having no special shape, In a preferred embodiment a damper member is provided to reciprocate between two extremes of travel through a notional midpoint. In one variation of such an embodiment the damper member defines a central closure means and each inlet flow control aperture comprises an elongate longitudinal slot in the conduit wall which is tapered in a transverse direction from a wider extent in a direction towards a midpoint of the travel of the damper member to a narrower extent in a direction towards an extreme of travel of the damper member. In an alternative variation of such an embodiment the damper member defines a central aperture and each inlet flow control aperture comprises an elongate longitudinal slot in the conduit wall which is tapered in a transverse direction from a wider extent in a direction towards an extreme of the travel of the damper member to a narrower extent in a direction towards a midpoint of travel of the damper member.

As a consequence of this arrangement the common movable flow control damper disposed about the outer conduit wall surface is able to partition flow from a common supply via the flow zone externally of the elongate conduit wall selectively between the two internal flow zones in that the at least one damper member is movable longitudinally in reciprocating manner parallel to the longitudinal direction of the conduit and across such flow control apertures to selectively limit fluid flow therethrough and thus in use to selectively distribute the fluid supply between the two streams defined by the respective flow zones.

In a preferred case, the intended fluid is gas, each flow zone comprises a gas flow zone, and the device distributes gas from a common supply stream into at least two delivery streams.

In a particularly preferred application, discussed in detail below, the damper may be used to partition gas flow from a common supply into plural flow streams in combustion device and for example to partition gas flow into plural combustion air and/or overfire air streams in a burner such as a burner for firing fossil fuels. The invention is discussed and advantages considered in the context of that use in particular. However it will be understood that the fluid flow control device or damper of first aspect of the invention is not limited to such an application.

The invention is thus based upon a movable damper such as a sleeve type damper, but is distinguished from a typical prior art arrangement where separate sleeve dampers control individual streams in that the damper is designed to have a dual effect whereby movement of the damper simultaneously controls the fluid flow to at least two separate internal flow zones, for example in the preferred application constituting combustion gas streams in a burner, for example to secondary and tertiary or tertiary and quaternary streams. A dual-acting movable damper in accordance with this aspect of the invention is able to replace two individual sleeve dampers (or other flow control devices) such as might conventionally be employed in much of the prior art to allow the proportioning of the combustion gas between two separate streams supplying combustion gas to a combustion site.

A dual-acting movable damper in accordance with this aspect of the invention is further distinguished in the preferred case in that the apertures are distinctly adapted to facilitate more linear partitioning of fluid from a common supply stream such as, in the preferred application, gas from a common burner windbox into the respective delivery streams.

The inlet flow control apertures are distinctly adapted to facilitate this in that the variation in area open to a given delivery stream is non-linear with movement of the common flow control damper in that the reduction rate reduces as the damper moves to a position where the open area tends to a more restricted (i.e. more nearly completely occluded) condition. For example in the preferred case where aperture(s) comprise longitudinal slot(s) in the conduit wall each aperture is modified from the rectangular slot conventional in the art and instead comprises an elongate longitudinal slot in a wall defining and providing a fluid inlet to its respective internal gas flow zone which is tapered in a transverse direction from a narrower extent in a direction where the damper tends to close the aperture to a wider extent in an open direction. For example in the preferred case of paired apertures for two internal flow zones with a reciprocating damper member between each aperture is tapered towards an extreme of travel of the damper member to a wider extent towards the midpoint of the system. Such an arrangement is preferred in a partitioning damper as a more linear response in the flow partitioning is generated by the movement of the damper. That is to say, the biasing of the flow from one flow conduit to another follows an approximately linear response to the longitudinal movement of damper position. Any degree and shape of taper is likely to confer advantages over a simple rectangular slot, which tends to produce a substantially non-linear response with a more rapid occluding effect as the damper position approaches a closed position. Optimisation of the shape of the taper may bring closer approximation to linearity of flow partitioning with damper position.

Conveniently, a first zone and a second zone have longitudinally spaced flow control aperture(s). The at least one damper member is movable longitudinally relative to and over the inlet flow control apertures in reciprocating manner between two extremes of travel and through a notional midpoint. As it moves in a first direction towards a first extreme it tends to restrict flow selectively preferentially to inlet flow control aperture(s) in that first direction defining a fluid supply to a first internal flow zone, for example defining a first combustion gas stream and/or open flow selectively preferentially to inlet flow control aperture(s) in the other direction defining a fluid supply to a second internal flow zone, for example defining a second combustion gas stream. In particular preferably it is so configured relatively to the inlet flow control aperture(s) that at the first extreme it substantially entirely occludes fluid flow into the first zone. As it moves in a second direction towards the other, second extreme it tends to restrict flow selectively preferentially to inlet flow control aperture(s) in that second direction defining a fluid supply to a second internal flow zone, for example defining a second combustion gas stream and/or open flow selectively preferentially to inlet flow control aperture(s) in the other direction defining a fluid supply to a first internal flow zone, for example defining a first combustion gas stream. In particular preferably it is so configured relatively to the inlet flow control aperture(s) that at the second extreme it substantially entirely occludes flow into the second zone. Between these two extremes the flow is partitioned to varying degrees. Conveniently at the notional midpoint, the damper member is so configured relatively to the inlet flow control aperture(s) that flow is partitioned to a neutral extent corresponding to a default mode of operation, for example, though not necessarily 50:50.

The flow control damper conveniently comprises a sleeve damper having at least one sleeve damper member complementarily shaped with and surroundingly disposed about and closely associated with at least a part of the surface of the conduit wall and movable longitudinally relative to the conduit such as to selectively limit flow through inlet flow control apertures defining a fluid inlet supply to each of the two internal flow zones site and thus in use to proportion fluid from a common supply stream via a fluid flow zone externally of the conduit wall between the two internal fluid flow zones.

This may be achieved either in that the sleeve damper member is a simple closure which limits flow when over a flow control aperture in the conduit or in that it also comprises apertures which selectively limit flow by relative position to a flow control aperture in the conduit or by combination of these effects. The sleeve damper member may have shaped apertures and/or shaped edges. A sleeve damper may have plural sleeve damper members, for example linked to move together. In a possible example of this, one or more sleeve damper members positioned to control flow through aperture(s) into a first delivery stream are linked to move together with one or more sleeve damper members positioned to control flow through aperture(s) into a second delivery stream.

In the preferred case a gas flow is partitioned from a common supply stream to two delivery streams. For example combustion gas is partitioned from a common between two streams supplying a combustion site.

The at least one sleeve damper member is surroundingly disposed about the conduit wall at least to a corresponding extent to the flow control apertures. In the preferred case, flow control apertures are disposed around the entire periphery of the conduit wall and at least one sleeve damper member is similarly surroundingly disposed about the entire periphery of the conduit wall.

The conduit is conveniently cylindrical. The sleeve damper is then preferably a cylindrical sleeve damper, having at least one integral or modular cylindrical sleeve damper member movable, in the preferred case axially movable, relative to the conduit.

The conduit is partitioned into at least two, and preferably exactly two, internal flow zones by internal flow partitioning means. The flow partitioning means is so configured that flow inlet(s) to the respective internal flow zones are spaced. preferably longitudinally, on the conduit wall. For example the internal flow partitioning means may comprise a wall member defining a first internal flow zone inlet region having flow inlets at a first portion of the conduit wall and a second internal flow zone inlet region having flow inlets at a second portion of the conduit wall longitudinally spaced from the first. The wall member then forms a continuous partition downstream of the flow inlets defining respective longitudinal first and second longitudinal flow zones. The two zones may be generally concentrically disposed about an elongate longitudinal direction of the conduit. One of said zones may be a central zone of the elongate conduit and the other a peripheral zone. Alternatively both zones may be peripheral and the conduit may define further zones, whether in fluid communication with a flow zone external to the conduit wall or otherwise supplied, without departing from the principles of the invention.

Each internal flow zone between which flow is partitioned preferably comprises a plurality of inlet flow control apertures. In a possible embodiment these are identically dimensioned. In other cases it may be desirable (for example for mechanical reasons and/or to generate the non-linear variation in exposed area discussed above) that these might be of different dimensions.

Preferably the inlet flow control apertures are disposed around substantially an entire perimeter of the conduit, and in the preferred case circumferentially around a cylindrical conduit.

In a possible embodiment the inlet flow control apertures are disposed in evenly spaced manner around the perimeter of the conduit. In other cases it may be desirable (for example for mechanical reasons and/or to generate the non-linear variation in exposed area discussed above) to have apertures variably spaced.

Apertures may be rectangular (have parallel walls in a direction of travel of the damper) but are preferably tapered for the reasons set out above. Suitable shapes for the inlet flow control apertures or at least any tapered portions thereof include triangular, trapezoidal, ogival, elliptical, hemispherical or other continuous curve, and any other tapered shape. Preferably the tapered shape is mirror symmetrical about a longitudinal axis.

The at least one damper member is movable, in the preferred case in a direction parallel to a longitudinal direction of the conduit, in reciprocating manner between a first position where it tends to restrict flow to a greater extent to a first fluid inlet to a first zone and a second position where it tends to restrict flow to a greater extent to a second fluid inlet to a second zone and thus effect relative partitioning between the two zones. This may be effected in that each such zone may have a separate set of flow control apertures disposed respectively either side of a notional midpoint of the travel of the damper member.

However, in a preferred case, the fluid inlet to each internal flow zone is defined by means of common apertures within the conduit wall so disposed relative to the flow partition means that a part of each common aperture defines an inlet to the first zone and a part of the common aperture defines an inlet to the zone conduit, and the damper member is configured to move in reciprocating manner across and over such common apertures so as to selectively proportion flow between the respective parts of the common aperture(s), and hence to the respective internal flow zones. In use the damper member is configured to sit over the common aperture(s) so as to define two separate fluid flow routes, from a fluid flow zone external to the conduit wall respectively through the two fluid flow zones internal to the conduit wall. Its reciprocating action has the effect of varying the relative sizes of the respective parts of a common aperture open to flow and hence partitioning fluid flow between the zones.

A common aperture in accordance with such a preferred embodiment is preferably tapered towards each end and widest towards the middle. For example a common aperture comprises a first tapered portion tapered towards a first end and defining in use an inlet to a first internal flow zone, a second tapered portion tapered towards a second end and defining in use an inlet to a second internal flow zone, and a central portion over which the damper member is seated. The central portion may have parallel longitudinally extending edges.

The first and second tapered portions may be identically shaped and dimensioned. That is, the aperture may be symmetrical. Alternatively the first and second tapered portions may be differently shaped or dimensioned for different flow characteristics.

A particularly preferred shape for a common aperture is an ellipse or other continuous closed curve, in particular with equivalent x, y symmetry.

In a preferred case, the damper of the first aspect of the invention is adapted for use with a combustion device and for example in the control of distribution of combustion air or overfire air in a burner for firing fossil fuels.

Thus, in accordance with the example in a second aspect, a combustion device is provided defining plural gas flow zones, wherein at least two of such gas flow zones are supplied by a common gas supply means, and wherein a flow control device as above described is positioned fluidly in stream between such a common gas supply means and such at least two gas flow zones to partition gas flow selectively therebetween in use.

More completely in accordance with the second aspect, a combustion device is provided comprising:

a common gas supply means defining a gas supply stream;

an elongate conduit comprising an outer wall and internal flow partitioning means defining internal flow zones for at least two gas delivery streams; one or more inlet flow control apertures disposed in the outer conduit wall to provide a gas flow communication from the gas supply stream into each such internal flow zone, the internal flow partitioning means being so configured that flow inlet(s) to the respective internal flow zones are spaced, for example longitudinally, on the conduit wall;

a common movable flow control damper disposed about the outer conduit wall surface comprising at least one damper member movable about and over a portion of the conduit surface at which the inlet flow control aperture(s) defining a gas supply to each of the said internal gas flow zones are located in such manner as to selectively restrict flow through the inlet flow control aperture(s) of the respective internal flow zones so as to effect relative flow modification between the said delivery streams.

Preferred features of the damper and flow control elements of the combustion device may be inferred from the description of the first aspect of the invention.

The common gas supply means may be a combustion gas and/or overtire gas supply means, and for example a combustion air and/or overtire air supply means. The said delivery streams therefore comprise partitioned combustion gas and/or overtire gas. The combustion device further comprises gas delivery conduits each defining a flow means to supply respectively partitioned combustion gas and/or overtire gas to a combustion site defined by the combustion device.

The combustion device preferably further comprises a fuel delivery conduit defining a flow means to supply fuel to a combustion site defined by the combustion device. The fuel may optionally be entrained in a transport gas. The combustion device is for example a burner for firing fossil fuels. In the preferred case the invention relates to a pulverised coal fired burner, though it is also applicable to burners for other fossil fuels such as light oils, heavy fuel oil, orimulsion, and natural gas, etc.

In a preferred operational mode, the flow control device of the first aspect of the invention is used to partition combustion air such as combustion gas within a burner between at least two combustion gas supply zones. In a particularly preferred case the burner comprises a burner having a core primary stream, for example carrying fuel, and at least two peripheral streams for example supplied with combustion gas.

Thus, according to a third aspect of the present invention, there is provided a burner for a combustion apparatus comprising an elongate conduit defining:

primary channel means defining a primary flow zone for supplying fuel to a combustion site provided longitudinally along the burner;

a combustion gas supply means such as a windbox;

further channel means defining at least two further flow zones each having one or more inlet flow control apertures to receive combustion gas from the combustion gas supply means and each defining a combustion gas flow zone for supplying combustion gas to the combustion site, the further flow zones being so configured that flow inlet(s) to the respective flow zones are spaced on the conduit wall;

a common movable flow control damper disposed about the conduit wall surface comprising at least one damper member movable about and over a portion of the conduit surface at which the inlet flow control aperture(s) defining a gas supply to each of the said combustion gas flow zones are located in such manner as to selectively restrict flow through the inlet flow control aperture(s) of the respective combustion gas flow zones so as to effect relative flow modification between the combustion gas flow streams.

In a preferred embodiment, the primary channel means defines a central flow zone and the channel means for the at least two further flow streams are disposed around the outer periphery of the primary channel means defining respective flow zones disposed around the central flow zone, for example in annular manner, and for example concentrically.

In further discussion herein of preferred combustion devices/burners in accordance with the second and third aspects of the invention the central flow zone defining the fuel supply may be referred to as the primary supply stream and the peripheral zones defining peripheral combustion gas supply as secondary, tertiary, quaternary etc. Such terms are for convenience only and should not be considered as limited to exclude alternative terms used for equivalent systems by others skilled in the art. It will be appreciated that a burner geometry with at least generally an axial symmetry might be preferred, with the central flow zone comprising an axial zone and peripheral zones comprising annular zones. References to axial and annular flow and to an axial direction may be used herein for convenience interchangeably with references to central and peripheral flow and to a longitudinal direction as familiarly in the art, without, except where the context necessarily demands it, necessarily implying a specific burner geometry.

During operation of a burner in accordance with the invention, combustion gas such as combustion air is supplied in familiar manner, for example via a common windbox. The combustion gas is split into two or more separate gas streams (commonly referred to and referred to herein as secondary, tertiary, quaternary etc.) disposed, typically concentrically, around the outer periphery of a primary central fuel pipe carrying fuel, for example, a mixture of pulverised coal and transport air (sometimes referred to and referred to herein as primary gas/air). The combustion gas may be swirled. Such an arrangement is generally known.

However, the invention is distinctively characterised in that the split between at least two of the separate combustion gas streams is regulated by a single dual-acting movable damper. The common movable flow control damper is a sleeve damper adapted to control relative flow of combustion gas from a common gas supply means between such combustion gas streams.

The common movable flow control damper comprises at least one damper member movable longitudinally and for example axially relative to the burner in such manner as to selectively modify combustion gas flow between two flow streams in use. Conveniently adjustment of the damper member is undertaken by means of axially acting control means such as control rods or other similar devices giving a reciprocating action either directly or via a suitable arrangement of gears, screw threading or the like.

In a refinement to the invention, the shape of the slots selectively exposed and obscured by the movement of the damper has been optimised as described in detail below. Elliptical openings are preferred, but the slots can also be of different shapes, including rectangular and triangular, and they can have various aspect ratios.

In a convenient embodiment, a primary conduit may be provided axially along the burner, for example comprising a primary channel means defining an axial flow zone, with secondary and tertiary conduits disposed around the outer periphery of the central primary conduit, for example comprising secondary and tertiary channel means defining respectively secondary and tertiary flow zones disposed around the axial flow zone. The secondary and tertiary channel means conveniently define annular flow zones around the axial flow zone, in particular concentric annular flow zones. Further higher-order conduits may optionally be provided to provide further gas streams for combustion or other gases.

The damper member is adapted to cooperate with one or more flow control apertures defining a gas supply to each of the two flow conduits so as to effect such flow modification. In the preferred embodiment, the damper member is adapted to cooperate with one or more flow control apertures defining a gas supply to concentric annular secondary and tertiary conduits. In particular, each of the secondary and tertiary flow conduits defines one or more inlet flow control apertures defining a gas supply route and the damper member is movable axially parallel to the longitudinal axis of the burner and across such flow control apertures to selectively limit gas flow therethrough and thus in use to proportion the combustion gas between the secondary and tertiary streams supplying the combustion site.

The flow control damper in this embodiment conveniently comprises a cylindrical sleeve damper, having at least one cylindrical sleeve damper member movable axially relative to the burner such as to selectively limit flow through inlet flow control apertures defining a gas supply to each of the secondary and tertiary flow conduits and thus in use to proportion the combustion gas between the secondary and tertiary streams supplying the combustion site. In a preferred arrangement a cylindrical sleeve damper member sits over a multiplicity of flow control apertures and is movable axially such as to selectively proportion the combustion gas flow between the secondary and tertiary streams for example by selective restriction and for example by selective opening and closing of said multiple flow control apertures.

The combustion gas may conveniently be combustion air or alternatively a suitable oxygen-containing mixture able to support combustion of the fuel, the combustion gas supply means being adapted to supply the same. A transport gas supply means may supply transport gas to the primary conduit such that fuel is supplied to a combustion site entrained in or mixed with the transport gas. The transport gas may be a combustion gas such as combustion air or other suitable oxygen-containing mixture able to support combustion, whether the same as the combustion gas supplied to the combustion gas streams or otherwise.

The combustion gas supply means may typically comprise a common windbox fluidly connected to an inlet region of at least those combustion gas conduits between which the damper is positioned to partition the gas stream.

One or more of the combustion gas conduits and for example either or both of the secondary and tertiary conduits and/or any higher order conduits as the case may be may be provided with suitable swirl generation structures, for example comprising axial swirl vanes, to impart an axial swirl to a gas supply therein.

In a more complete aspect of the present invention, there is provided a combustion apparatus comprising:

a combustion chamber; and at least one and preferably a plurality of combustion devices/burners as hereinbefore described located so as to define combustion sites within the combustion chamber.

Preferably the combustion apparatus comprises a boiler for generating steam.

The fuel used is preferably a combustible fossil fuel, for example selected from coal and in particular pulverised coal, light fuel oil, heavy fuel oil, orimulsion, natural gas, etc. Preferably the fuel used is coal, most preferably pulverised coal.

The fuel may be supplied entrained in or mixed with a transport gas.

The combustion gas may conveniently be combustion air or alternatively a suitable oxygen-containing mixture able to support combustion. The transport gas may be a combustion gas such as combustion air or other suitable oxygen-containing mixture able to support combustion, whether the same as the combustion gas supplied to the secondary and tertiary combustion gas streams such as the secondary and tertiary streams or otherwise.

SUMMARY OF FIGURES

The invention is described by way of example only with reference to FIGS. 1 to 5 of the accompanying drawings in which.

SPECIFIC DESCRIPTION

In accordance with the invention the air split between the two main combustion air streams is regulated by a single dual-acting sleeve damper. A representation of an embodiment dual-acting damper in accordance with the principles of the invention of is presented in FIGS. 1 and 2.

Figure 1:
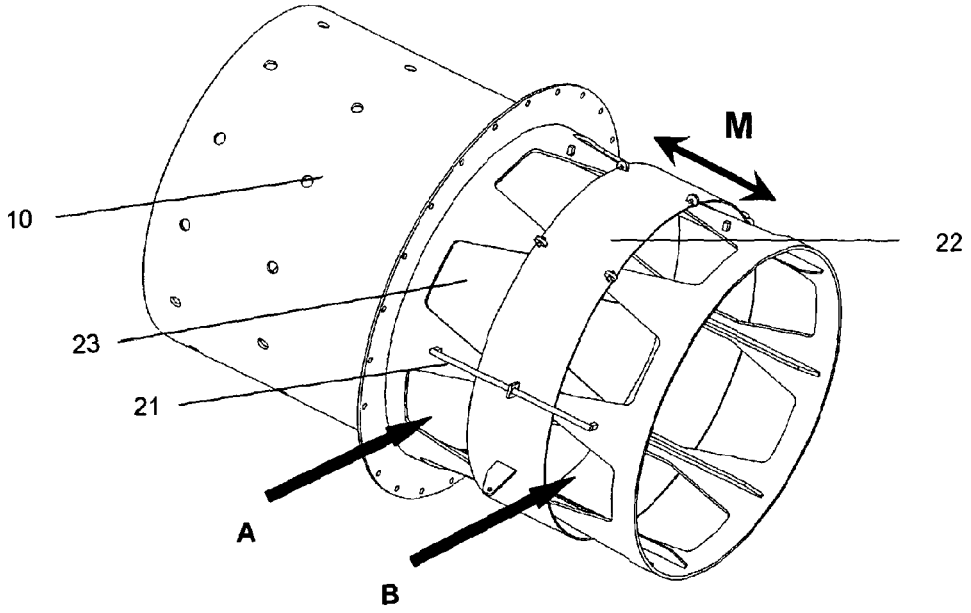
FIG. 1 is a schematic view of a dual-acting sleeve damper in accordance with an embodiment of the invention.

A cylindrical sleeve damper 22, adjustment of which is undertaken by means of control rods 21 or other similar device giving a "push-pull" action, sits over a multiplicity of slots 23 in an outer surface of a conduit 10. The slots shown in FIG. 1 are truncated triangular slots; other slot shapes may be used (rectangular, triangular, elliptical), with elliptical slots being the preferred embodiment; the slots may be joined at their base. The slots form the opening to different channels defined within the conduit 10 for different streams of air (shown as Stream "A" and Stream "B" in FIG. 1) which are physically separated into separate flow channels.

Figure 2:
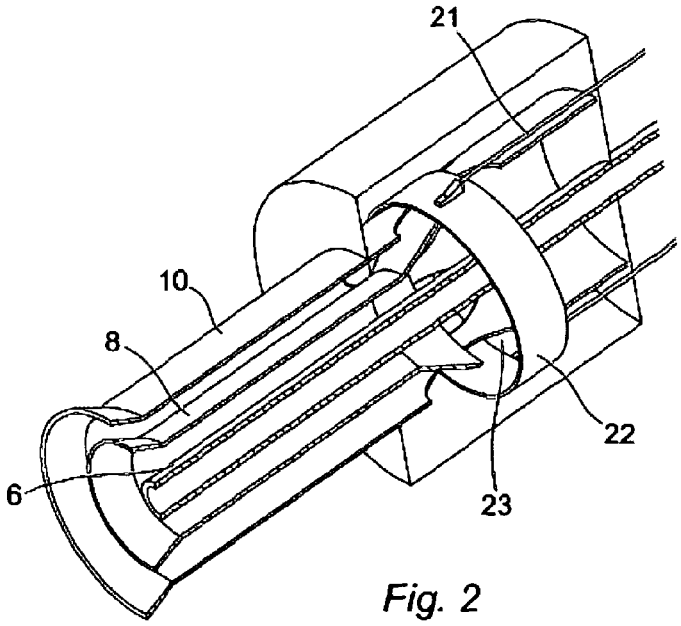
FIG. 2 is an isometric view of a generic low NOx burner with a dual-acting sleeve damper in accordance with an embodiment of the invention to control secondary: tertiary air split.
Figure 5:
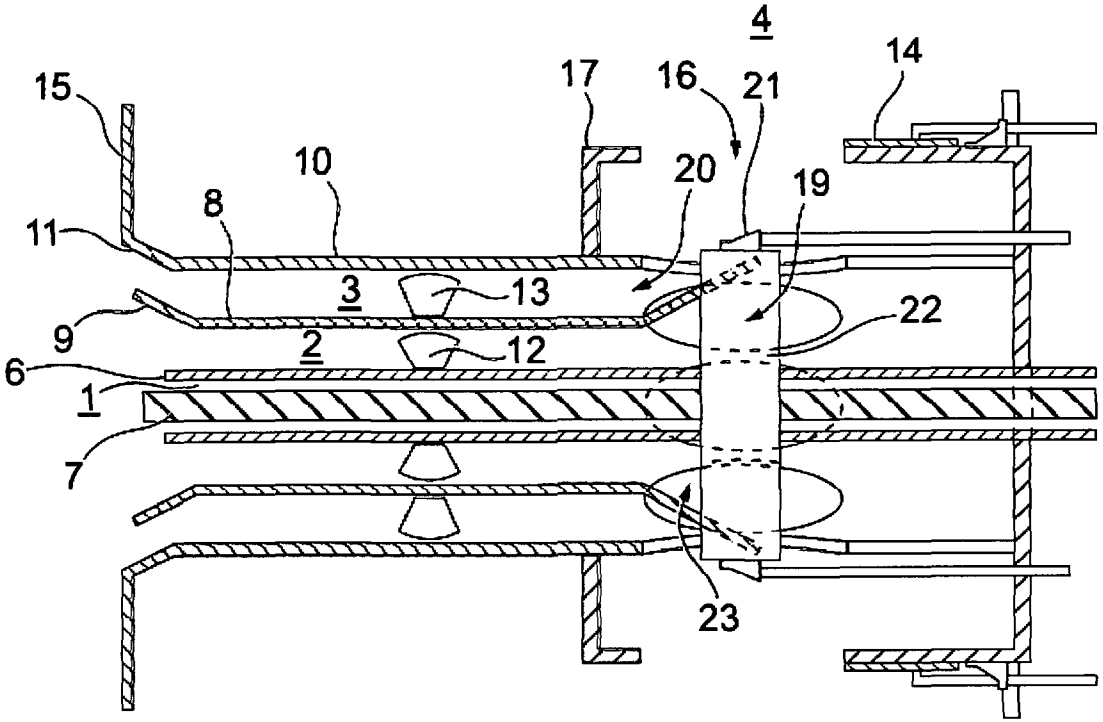
FIG. 5 is a partial cross-section of a generic low NOx burner with dual-acting damper in accordance with an embodiment of the invention.

A suitable arrangement to effect this is shown in FIG. 2 and an alternative arrangement is shown in FIG. 5. In each case, a concentric primary air pipe 6, secondary air pipe 8, and tertiary air pipe 10 divide the conduit into separate elongate flow channels for primary, secondary and tertiary air. The sleeve damper sits over a common aperture 23 to a pair of such channels comprising the secondary and tertiary air channels. Movement of the sleeve damper 22 reciprocally in direction M causes the free flow area of the slots opening into one channel to be reduced whilst simultaneously the free flow area to the other channel is increased. By this means it is possible to proportion the air flow between the channels with a single damper.

The shape of the slots 23 is defined in such a way that the damper response is approximately linear; by this it is meant that the biasing of the flow from one channel to another follows more approximately than is the case with rectangular slots linear response to the damper position. In practice this means that the area of the opening changes in a non-linear way as the damper position is adjusted, and the slot width reduces towards the "closed" position.

Figure 3:
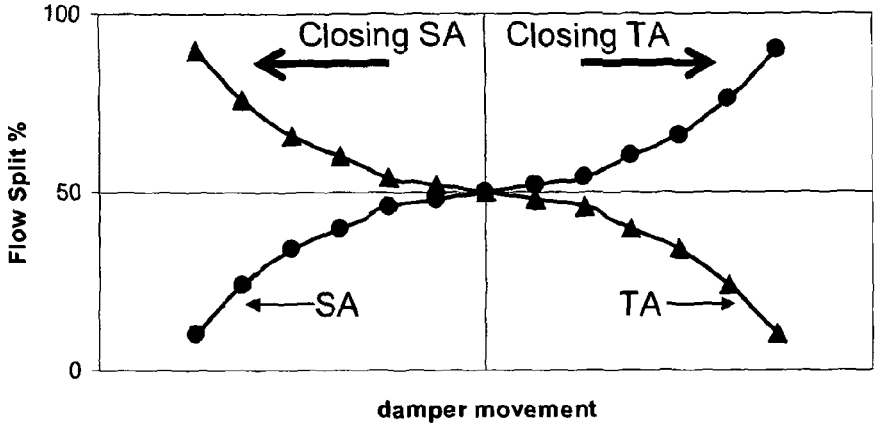
FIG. 3 is a graph relating flow split response to damper position in the embodiment of FIG. 2.
Figure 4:
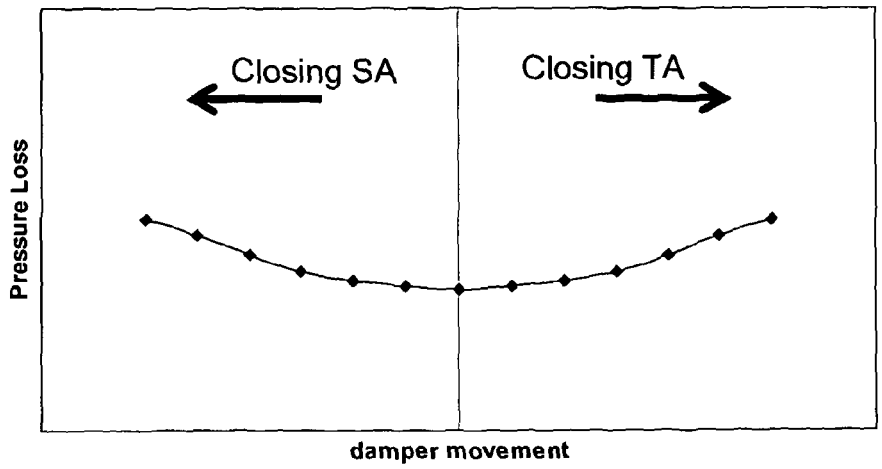
FIG. 4 is a graph relating burner pressure drop to damper position in the embodiment of FIG. 2.

The invention offers a number of advantages over the use of separate dampers for each air stream. Firstly the mechanical complexity is reduced, offering reductions in manufacturing cost and simplifying the maintenance of the burner. Secondly air flow split is achieved with the maximum free flow area, leading to lower pressure drop compared to the previous arrangement. Thirdly the number of independent adjustments to burner settings is reduced, leading to easier optimisation of burner performance and reduced set-up time; because a single damper is used to control one parameter (the flow split) there is no loss of functionality. Fourthly the flow split shows an approximately linear response over most of the damper adjustment (as shown in FIG. 3 which exemplifies a split between secondary and tertiary air; SA & TA). Fifthly the overall pressure drop across the device is approximately constant for the whole range of damper position/flow split (as shown in FIG. 4, also exemplified by the SA/TA split).

FIG. 5 presents a cross-sectional schematic view of a generic low NOx burner in which the invention, a dual acting sleeve damper, has been installed. In this embodiment, the burner is arranged for pulverised coal combustion; those knowledgeable in the art of burner design will recognise that the invention could be equally applied to burners firing other fossil fuels such as light oil, heavy fuel oil, orimulsion, natural gas, etc.

The burner shown in FIG. 5 comprises a central pipe 6 to convey the pulverised coal and primary air stream 1. Optionally this pipe may contain an additional pipe 7 to facilitate one or more of the following: air for a light-up burner, the light-up burner, the light-up burner ignitor, and flame sensing devices (not shown).

The combustion air 16 is supplied via a windbox 4. Optionally the flow of combustion air may be regulated or shut-off by a sleeve damper 14, in which case the individual burner air supply is bounded by a plenum 17. The combustion air 16 is then divided into secondary air 2 at 19 and tertiary air 3 at 20 as it enters via shaped slots 23; these slots are preferentially elliptical in shape, but can take different shapes—e.g. rectangular, triangular, truncated triangular, etc.

Secondary air 2 and tertiary air 3 are confined by the primary air pipe 6, the secondary air pipe 8, and the tertiary air pipe 10. Typically the tertiary air pipe 10 will terminate in a flow expansion called the burner quarl 11 before exiting to the furnace chamber 5. Optionally the secondary air pipe 8 may have an attachment 9 to assist the flow. Typically the secondary air 2 and the tertiary air 3 will be swirled by means of secondary air spin vanes 12 and tertiary air spin vanes 13.

The proportioning of the combustion air 16 into secondary air 2 and tertiary air 3 is achieved by a dual acting sleeve damper 22. The dual acting sleeve damper 22 is adjusted by means of a push-pull control rod mechanism 21. When the dual acting sleeve damper 22 is pushed forward towards the furnace chamber 5, the proportion of the combustion air 16 that goes to the tertiary air 3 is reduced, and the proportion that goes to the secondary air 2 is correspondingly increased. The shape of the slots 23 is selected so that linear movement of the dual acting sleeve damper 22 results in a linear response in the proportioning of the combustion air 16.

The invention claimed is:

1. A flow control device in a burner for partitioning a fluid flow from a common combustion air supply stream comprising:

an elongate conduit comprising an outer wall and internal pipes defining concentric secondary and tertiary annular flow channels inside the elongate conduit for supplying the combustion air of the burner into at least two delivery streams along an axial direction of the elongate conduit;

an aperture formed in the outer wall, the aperture configured to provide flow inlets for the combustion air into each of the secondary and tertiary annular flow channels, respectively, so that the aperture is common to the flow inlets for both the secondary and tertiary annular flow channels; and a damper sleeve disposed concentrically around an outer surface of the outer wall and configured to sliding move in the axial direction of the elongate conduit and over a portion of the outer surface of the outer wall at which the aperture is located so as to divide the common combustion air between the secondary and tertiary annular flow channels by selectively restricting flow through each of the flow inlets of the respective secondary and tertiary annular flow channels, wherein axial sliding movement of the sleeve damper over the aperture simultaneously increases an open area of the flow inlet of one of the annular flow channels and decreases an open area of the flow inlet of the other one of the annular flow channels, so as to partition the common combustion air supply flowing from outside of the elongate conduit into the secondary and tertiary annual flow channels inside the elongate conduit.

2. A flow control device in accordance with claim 1 wherein the flow inlets to the respective secondary and tertiary annular flow channels are longitudinally spaced along the axial direction of the elongate conduit.

3. A flow control device in accordance with claim 1 wherein the sleeve damper is configured such that movement thereof selectively varies flow in manner that is non-linear with movement of the sleeve damper in that the reduction rate reduces as the damper moves to a position where the open area tends to a more restricted condition.

4. A flow control device in accordance with claim 3 wherein the aperture is provided in a plurality, and the apertures taper in size as the closed condition is approached.

5. A flow control device in accordance with claim 4 wherein the sleeve damper is configured to reciprocate longitudinally and each of the apertures comprises an elongate longitudinal slot in the outer wall which is tapered in a transverse direction from a wider extent to a narrower extent in a direction corresponding to the direction of travel of the sleeve damper as it moves to a position where it restricts flow.

6. A flow control device in accordance with claim 4 wherein each of the apertures comprises an elongate longitudinal slot in the outer wall which is tapered in a transverse direction from a wider extent in a direction towards a midpoint of the travel of the damper member to a narrower extent in a direction towards an extreme of travel of the damper member.

7. A flow control device in accordance with claim 1 wherein the elongate conduit is cylindrical and the sleeve damper is cylindrical and movable axially relative to the elongate conduit.

8. A flow control device in accordance with claim 1 wherein a plurality of the apertures is provided for conveying the combustion air into each of the annular flow channels.

9. A flow control device in accordance with claim 8 wherein each of the apertures in the outer wall is identically dimensioned.

10. A flow control device in accordance with claim 9 wherein the apertures are evenly spaced around an entire perimeter of the outer wall.

11. A flow control device in accordance with claim 1 wherein the aperture is triangular, trapezoidal, ogival, elliptical, hemispherical or other continuous curve shaped.

12. A flow control device in accordance with claim 1 wherein the flow inlet to each of the secondary and tertiary annular flow channels is defined by the aperture within the outer wall disposed so that a part of the aperture defines the flow inlet to the secondary annular flow channel and a part of the aperture defines the flow inlet to the tertiary annular flow channel, and the sleeve damper is configured to move in reciprocating manner across and over the aperture so as to selectively proportion flow between the respective parts of the aperture, so as to selectively proportion flow between the secondary and tertiary annular flow channels.

13. A flow control device in accordance with claim 12 wherein the aperture comprises a first tapered portion tapered towards a first end and defining in use the flow inlet to the secondary annular flow channel and a second tapered portion tapered towards a second end and defining in use the flow inlet to the tertiary annular flow channel.

14. A flow control device in accordance with claim 13 wherein the first tapered portion and the second tapered portion are identically shaped and dimensioned.

15. A flow control device in accordance with claim 14 wherein the aperture is an ellipse or other continuous dosed curve with equivalent x, y symmetry.

16. A combustion device comprising a common gas supply means, and a flow control device according to claim 1.

17. A combustion device in accordance with claim 16 wherein the common gas supply means is a combustion gas and/or overfire gas supply means.

18. A combustion device in accordance with claim 17 wherein the combustion gas and/or overfire gas is supplied to a combustion site defined by the combustion device by the secondary and the tertiary annular flow channels and further comprising a fuel delivery conduit configured to supply fuel to the combustion site defined by the combustion device.

19. A combustion device in accordance with claim 18 comprising a burner for firing fossil fuels.

20. A burner for a combustion apparatus comprising:

an elongate conduit including, within an interior of the elongate conduit, primary channel means defining a primary flow zone for supplying fuel to a combustion site provided longitudinally along the burner, a combustion gas supply means such as a wind box;

the elongate conduit further including, within the interior of the elongate conduit, secondary channel means defining at least two secondary flow zones each having one or more inlet flow control apertures to receive combustion gas from the combustion gas supply means disposed outside of the elongate conduit and each of the inlet flow control apertures defining a combustion gas flow zone for supplying combustion gas to the combustion site, the secondary flow zones configured so that the inlet flow control apertures to the respective flow zones are spaced on an outer wall of the conduit; and a common movable flow control damper disposed circumferentially around a perimeter of the outer wall of the conduit and comprising at least one sleeve damper movable along an axial direction of the conduit and over a portion of the outer wall at which the inlet flow control apertures are located so as to partition flow between the inlet flow control apertures of the respective combustion gas flow zones so as to proportion relative flow between the combustion gas flow zones, wherein axial sliding movement of the sleeve damper over the inlet flow control apertures simultaneously increases an open area of one of the inlet flow control apertures and decreases an open area of another one of the inlet flow control apertures.

21. A combustion device in accordance with claim 20 wherein the primary channel means defines a central flow zone and the secondary channel means are disposed around an outer periphery of the primary channel means defining respective flow zones disposed around the central flow zone.

* * * * *